United States Patent [19]

Antunez

[11] 4,365,365

[45] Dec. 28, 1982

[54] FLUSH VALVE AND MEANS FOR MOUNTING THE SAME

[76] Inventor: Bruce A. Antunez, 2153 Iron Club Dr., LaVerne, Calif. 91750

[21] Appl. No.: 296,875

[22] Filed: Aug. 27, 1981

[51] Int. Cl.[3] ..... E03D 1/35; E03D 1/06; E03D 5/04

[52] U.S. Cl. ..... 4/393; 4/378; 4/392

[58] Field of Search ..... 4/378, 379, 393, 392, 4/382, 324, 388

[56] References Cited

U.S. PATENT DOCUMENTS

| | | | |
|---|---|---|---|
| 2,512,694 | 6/1950 | Stout et al. | 4/378 X |
| 2,773,268 | 12/1956 | Husko et al. | 4/393 |
| 3,003,156 | 10/1961 | Alexander | 4/393 X |
| 3,167,787 | 2/1965 | Connealy | 4/393 |
| 4,002,521 | 1/1977 | Schoepe et al. | 4/378 |
| 4,028,748 | 6/1977 | Schoepe et al. | 4/393 |
| 4,080,669 | 3/1978 | Biggerstaff | 4/393 |
| 4,106,136 | 8/1978 | Lippincott, Sr. | 4/378 |
| 4,134,165 | 1/1979 | Phripp et al. | 4/379 |

*Primary Examiner*—Henry K. Artis
*Attorney, Agent, or Firm*—Donald D. Mon

[57] ABSTRACT

A flush valve adapted to be mounted to the bottom of a tank. The flush valve has a body with a drain conduit and an opening which can be opened and closed by a movable plug. The body has an internal thread in the drain conduit. A mounting seal has a flange that bears against the tank bottom and a skirt that fits in the drain port in the tank. An expander has an external thread which engages the internal thread, and also has a tapered expander section that enters and diametrally enlarges the skirt when the threads are progressively engaged. Enlargement of the skirt makes a fluid-tight seal and exerts a force which holds the body of the tank. Torque-tool engagement surfaces are formed in the expander so it can be turned.

4 Claims, 4 Drawing Figures

FIG. 1
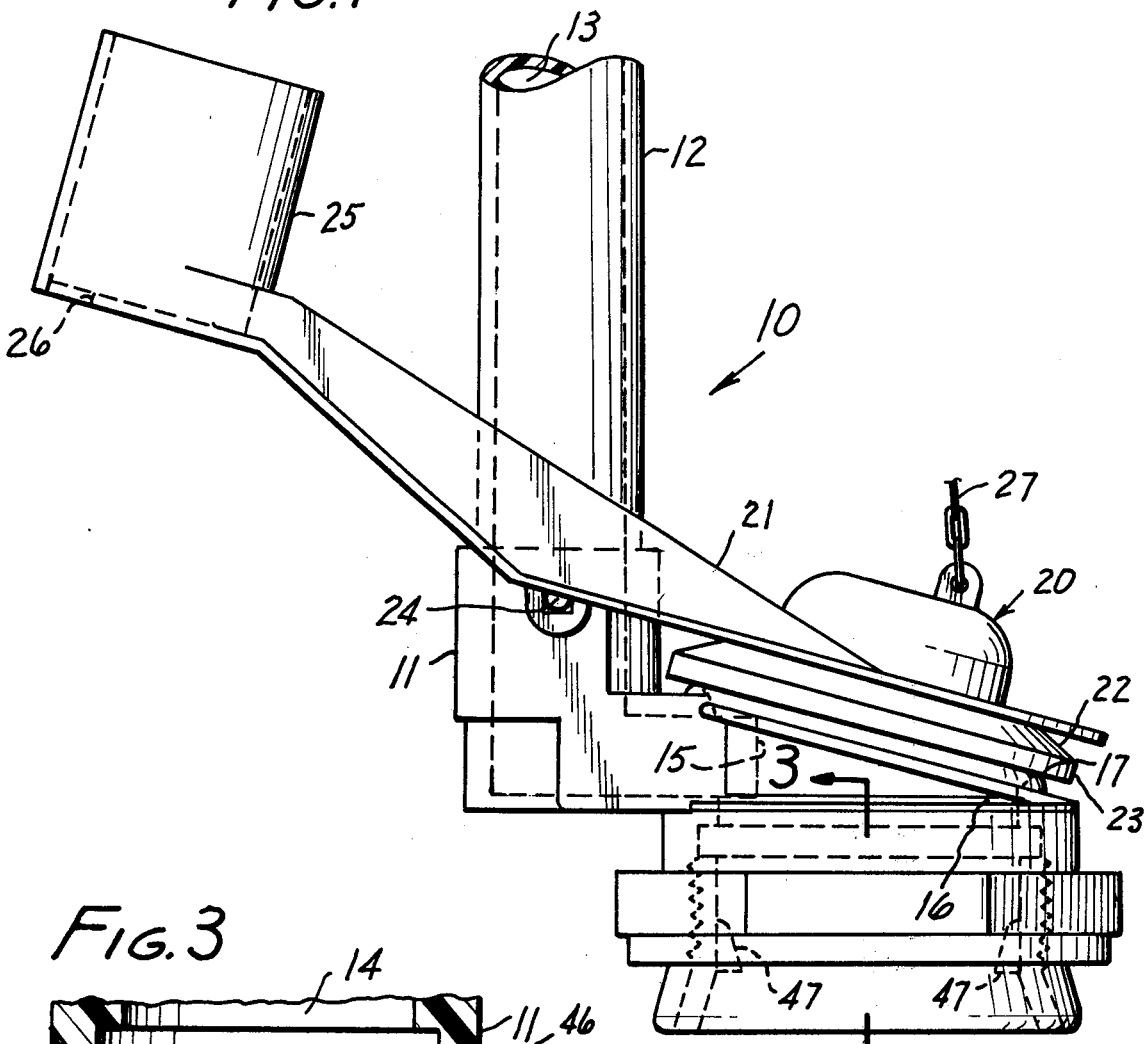
FIG. 3
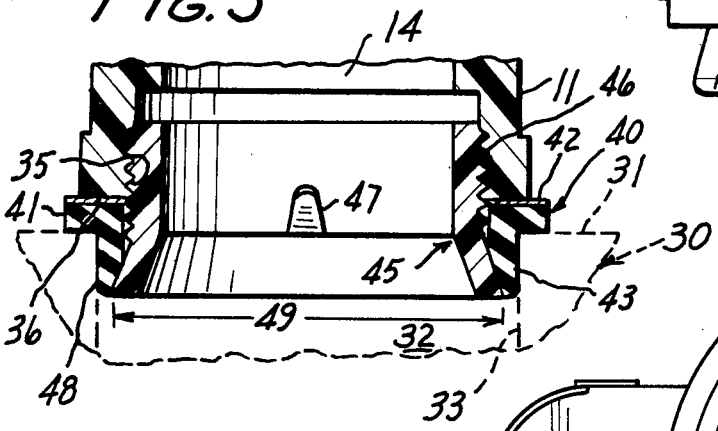
FIG. 2
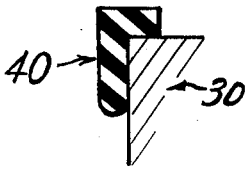
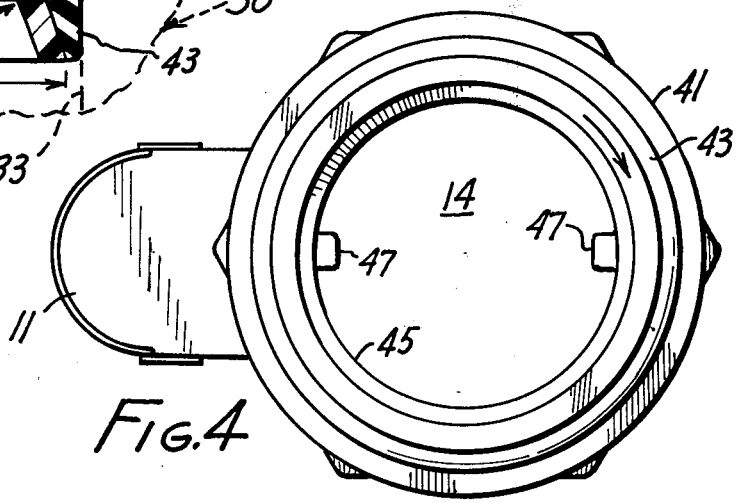
FIG. 4

FLUSH VALVE AND MEANS FOR MOUNTING THE SAME

FIELD OF THE INVENTION

This invention relates to tank flush valves and to means for mounting them to the bottom of a tank.

BACKGROUND OF THE INVENTION

Conventional toilet tank flush valves are mounted to a tank by means which require access to both sides of the tank. The installation, removal, and replacement of such valves can be troublesome, especially for the homeowner.

It is an object of this invention to provide a toilet tank flush valve which can conveniently be installed from either the inside or the outside of the tank, and in which the means for making the seal with the tank wall is also the means for physically holding the flush valve to the tank. This greatly simplifies the flush valve construction.

BRIEF DESCRIPTION OF THE INVENTION

A flush valve according to this invention is adapted to be mounted in a drain port in the bottom wall of a tank. The flush valve has a body which forms a drain conduit that has an opening to receive water. There is a seat on the body surrounding the opening. A plug member has a seal adapted to bear against the seat to close the opening. The plug member is movably mounted to the body so as to move the seal against and away from the seat. An internal thread is provided in the drain conduit. A mounting seal has a flange and a tubular skirt. The flange bears against the bottom of the tank around the drain port and the skirt enters the drain port so it can be brought to bear against the peripheral wall of the drain port. A tubular expander has an external thread which is threaded into the internal thread and includes a tapered expander section which, as the threads are progressively engaged, enters the skirt and diametrally expands it against the wall of the drain port. This seals the drain port and physically holds the body to the tank. Wrench-engaging means is provided inside the expander for engagement by a torque tool so it can be turned.

The invention will be fully understood from the following detailed description and accompanying drawings, in which:

BRIEF DESCRIPTION OF THE DRAWINGS

FIG. 1 is a side elevation of the presently preferred embodiment of the invention;

FIG. 2 is a fragmentary section view of a part of the device shown in FIG. 1;

FIG. 3 is a cross-section taken at line 3—3 in FIG. 1; and

FIG. 4 is a bottom view of FIG. 1.

DETAILED DESCRIPTION OF THE INVENTION

A flush valve 10 according to the invention is shown in FIG. 1. It includes a body 11 which supports an overflow pipe 12 that rises to a suitable elevation and includes an overflow passage 13 which discharges into a drain conduit 14 through an overflow port 15. The drain conduit passes downwardly as best shown in FIG. 3.

An opening 16 in the top of the body gives access to the drain conduit. A seat 17 is peripherally formed around the opening. A plug member 20 is mounted to a lever 21 and includes a plug 22 adapted to bear against the seat 17. It includes an elastomeric seal 23. Lever 21 is pivotally mounted to the body by pivots 24, and may be provided with a counterweight member 25 in the form of a receptacle having a drain hole 26 in the bottom according to known constructions. A chain 27 is provided to be attached to flush linkage for the purpose of lifting the plug away from the seat 17 to open the same. The foregoing details of construction are well known in the art.

It is the purpose of this invention to provide convenient means for mounting the above device to the bottom of a tank 30. The bottom wall of the tank 30 has an upper surface 31. A drain port 32 extends through the bottom of the tank. The drain port includes an internal peripheral wall 33. Such tanks are generally made of rigid material. As best shown in FIGS. 1 and 3, an internal thread 35 is formed in the body of the flush valve, surrounding the drain conduit. The body has a bearing surface 36 at its lower face.

A mounting seal 40 is circular and includes a flange 41 adapted to bear against the bearing surface 36 of flush valve 10 and against upper surface 31 of the tank adjacent to the drain port. If desired, an anti-rotation washer 42 can be placed between surface 31 and flange 41 to restrain the mounting seal from rotation relative to the body, washer 42 being construed to be part of the body or of the mounting seal. The mounting seal further includes a skirt 43 which initially has undistorted diametral dimensions which will permit its insertion into the drain port as shown in FIG. 2.

An expander 45 has an external thread 46 to be threaded into thread 35. It includes a pair of lugs 47 to function as torque-tool engagement means. It also includes a tapered expander section 48 which tapers outwardly as it extends away from the thread, and has its largest diameter 49 at its free end. It tends to engage and radially enlarge the skirt of the mounting seal to press it against the peripheral wall in fluid sealing contact therewith, distorting the seal in so doing. It also exerts a sufficient force on the mounting seal so that it will hold the flush valve in the drain port.

The installation of the device should be evident from the foregoing. If the flush valve is being mounted in the drain port before the toilet tank is connected to drain pipes, then the torque-tool can readily be inserted from the top or from the bottom. For repair and replacement services that plug member could instead be moved out of the way and the torque-tool would be inserted from the top. In either event, when the flush valve is to be installed, the expander will have been lowered relative to the mounting seal so the skirt of the mounting seal can be pressed into the drain port and its flange brought against the bottom of the tank. Then the expander is turned so that it moves upwardly in FIG. 3, and expands the mounting seal skirt against the peripheral wall of the drain port. The flush valve is now fully installed. Removal is accomplished in the reverse manner, simply by turning the expander in the opposite direction.

This invention thereby provides a convenient means for mounting a flush valve to a drain port in a tank where all of the seals and mechanical attachments can be placed at a single side of the tank wall, and the installing forces can be exerted at only one side if desired.

This invention is not to be limited by the embodiment shown in the drawings and described in the description which is given by way of example and not of limitation, but only in accordance with the scope of the appended claims.

I claim:

1. A flush valve to be mounted in a drain port in the bottom wall of a tank, said bottom wall forming at the drain port a peripheral wall with substantial axial and diametral dimensions, said flush valve comprising: a body forming a drain conduit having an opening, a seat on said body surrounding said opening; a plug member having a seal adapted to bear against said seat to close said opening, said plug member being movably mounted to said body to move said seal toward and away from said seat; an internal thread in said drain conduit; a mounting seal having a flange and a tubular skirt, said flange being adapted to bear against said bottom wall inside said tank around said drain port, and said skirt being adapted to fit inside said peripheral wall; a tubular expander, said expander having an external thread adapted to engage said internal thread in said body, and a tapered expander section adapted to enter said skirt and diametrally expand the same against said peripheral wall as the external thread enters said internal thread; and wrench-engaging means inside said expander for engagement by a torque-tool.

2. A flush valve according to claim 1 in which said mounting seal is made of an elastomeric material.

3. A flush valve according to claim 1 in which a friction washer is placed between the mounting seal and the body to resist rotation of said mounting seal relative to said body.

4. A flush valve according to claim 1 in which said body further includes an overflow pipe which discharges into said drain conduit.

* * * * *